United States Patent [19]

Viletto

[11] 4,046,400

[45] Sept. 6, 1977

[54] BALL SKI BINDING

[76] Inventor: Felix A. Viletto, 116 Ford City Road, Freeport, Pa. 16229

[21] Appl. No.: 685,883

[22] Filed: May 12, 1976

[51] Int. Cl.[2] ..... A63C 9/08

[52] U.S. Cl. ..... 280/626

[58] Field of Search ..... 280/626, 627, 628, 633, 280/634, 617

[56] References Cited

U.S. PATENT DOCUMENTS

| | | | |
|---|---|---|---|
| 2,667,359 | 1/1954 | Goodman | 280/623 |
| 2,788,981 | 4/1957 | Emerson | 280/623 |
| 3,338,587 | 8/1967 | Wiley | 280/623 |
| 3,504,922 | 4/1970 | Wiley | 280/623 |

*Primary Examiner*—Robert R. Song

*Attorney, Agent, or Firm*—Clarence A. O'Brien; Harvey B. Jacobson

[57] ABSTRACT

A pair of front and rear abutment members are supported in longitudinally spaced position upon the mid-portion of a ski for vertical and lateral shifting relative to the ski and the abutment members include downwardly facing partial spherical seating surfaces abutted against upwardly facing seating surfaces on the ski. Coiled spring structure is enclosed within each abutment member and connected between the latter and the ski for yieldingly biasing the abutment members into tight seated engagement with the upwardly facing seating surfaces carried by the ski. A ski boot is provided and includes extending opposite heel and toe sole portions having upwardly and outwardly opening V-shaped notches formed therein and the ski boot is snugly received between the abutment members with the adjacent portions of the partial spherical surfaces of the abutment members seated in the upwardly and outwardly opening V-shaped notches in the extended toe and heel portions of the ski boot sole. In this manner the ski boot is clamped in position on the ski and yet may be disengaged from the latter as a result of sufficient pressure being exerted on one or both of the abutment members by the boot to cause displacement of either one or both of the abutment members from its seated position.

19 Claims, 12 Drawing Figures

BALL SKI BINDING

BACKGROUND OF THE INVENTION

Various forms of ski bindings have been heretofore designed for the purpose of enabling automatic release of an associated ski boot in response to excess forces being applied to the boot. Automatic releasing ski bindings are provided to minimize leg, foot and ankle injuries which may occur as a result of a skier falling and the importance of a ski binding which will release as a result of excess forces being exerted on the associated boot in substantially all horizontal directions as well as upward directions is known throughout the skiing industry.

Numerous bindings of different configurations are designed to allow release of an associated ski boot. However, for various design and operational reasons some forms of automatic releasing ski bindings do not perform in an optimum manner in all circumstances in which release of the associated ski boot is desired.

Examples of ski bindings of the automatic releasing type and utilizing some of the basic structural and operational features of the instant invention are disclosed in U.S. Pat. Nos. 2,718,403, 2,788,981, 3,258,274, 3,338,587, 3,379,447, 3,630,538, 3,632,123 and 3,635,486.

BRIEF DESCRIPTION OF THE INVENTION

The instant invention utilizes a specifically designed ski boot whose sole portion includes front and rear upwardly and outwardly opening V-shaped notches formed therein. The bindings also utilize abutment members having hemispherical undersurface portions supported in slightly elevated position above the associated ski on pedestal-type seats with coiled springs connected between the abutment members and the skis yieldingly retaining the abutment members upon their seats. The partial spherical undersurfaces of the adjacent portions of the abutment members seat in the corresponding notches formed in the associated ski boot sole and thereby retain the ski boot in proper position on the ski. However, when sufficient forces are applied to the ski boot the partial spherical undersurfaces of the adjacent portions of the abutment members and the V-shaped notches coact as cam surfaces in order to cam the abutment members out of seated positions against the ski supported seats and thereby enable the ski boot to be disengaged from the ski.

The main object of this invention is to provide a ski binding constructed in a manner whereby unfailing release of an associated ski boot from the ski as a result of excess forces being applied to the ski boot will be assured.

Another object of this invention is to provide a ski binding construction that may be readily released by the user through the utilization of a ski pole without the user having to assume a stooping position.

Another important object of this invention is to provide a ski binding construction which will not be adversely affected by icing conditions.

Yet another important object of this invention is to provide a ski binding construction that may be tailored to the needs of a specific user.

A final object of this invention to be specifically enumerated herein is to provide a ski binding construction in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
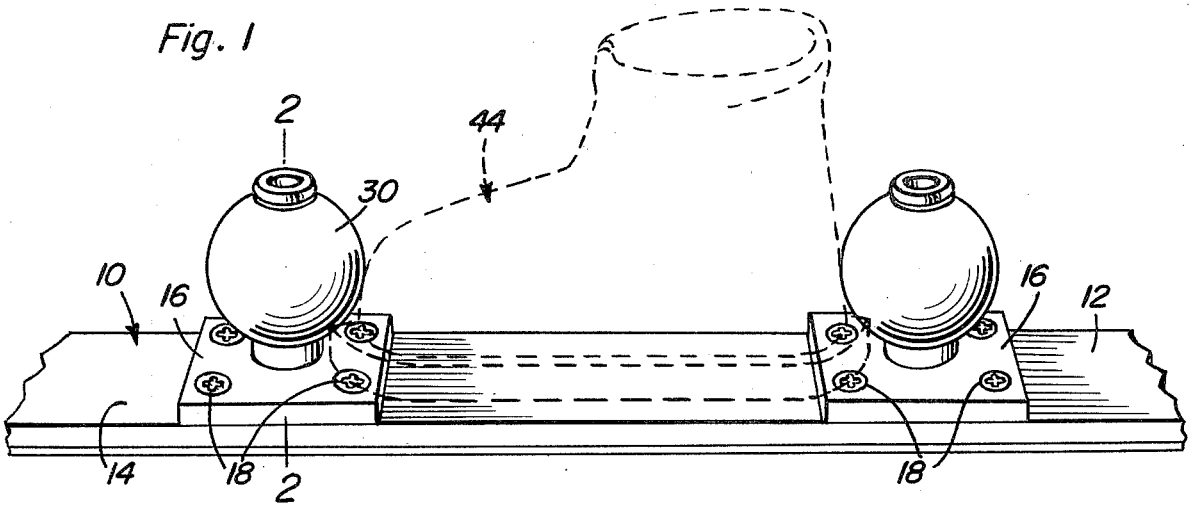
FIG. 1 is a fragmentary perspective view of a ski equipped with the binding structure of the instant invention.

Referring now more specifically to FIGS. 1 through 5 there will be seen a ski referred to in general by the reference numeral 10 defined by an elongated body 12 having an upper surface 14. A pair of mounting plates 16 are secured to the upper surface 14 by means of suitable fasteners 18 and each mounting plate 16 has a central opening 20 formed therethrough.

The lower end of a stiff coiled expansion spring 22 is secured by welding 24 in each opening 20 and an upstanding spacing sleeve 26 is disposed about the lower end of each spring 22 and abuts against the upper surface of the corresponding mounting plate 16 about the opening 20. The upper end of each spacing sleeve 26 has a partial spherical seating surface 28 formed thereon. A generally spherical abutment member 30 is provided and supported from the upper end of each spacing sleeve 28. The radius of curvature of the abutment members 30 corresponds with the radius of curvature of the seating surfaces 28 and each abutment member 30 has an upstanding threaded bore 32 formed therethrough including a smooth lower end counterbore 34. The threads of the bore 32 are such to enable the upper end of the spring 22 to be threaded therein and it will be noted that the upper end of the spring 22 is threaded upwardly into the bore 32 sufficiently to cause the convolutions of the lower end portion of the spring 22 to be spread apart. Thus, the spring 22 is tensioned so as to draw the abutment member 30 downwardly upon the seating surface 28.

A removable plug 36 including a diametrically enlaged head 38 is threaded down into the interior of the upper end of the spring 22 and a sealing washer 40 is disposed on the plug 36 between the head 38 and the upper surfaces of the abutment member 30 disposed about the bore 32. Also, it may be seen that the plug 36 includes an upwardly opening blind bore 42.

A ski boot is referred to in general by the reference numeral 44 and includes a thick sole portion 46 including toe and heel portions 48 and 50 which project endwise outwardly from the corresponding ends of the upper 52 of the boot 44. The portions 48 and 50 are provided with upwardly and outwardly opening V-shaped notches 54 and 56 which seatingly receive the opposing undersurface portions of the corresponding abutment members 30 when the boot 44 is in the position thereof illustrated in phantom lines in FIG. 1.

Figure 2:
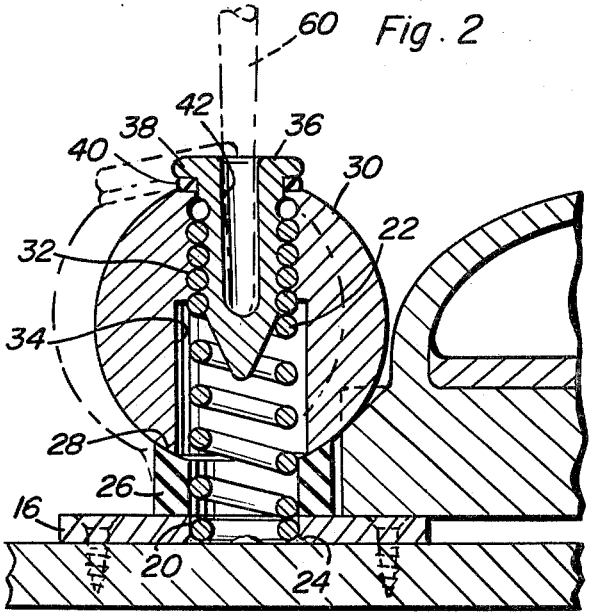
FIG. 2 is an enlarged fragmentary longitudinal vertical sectional view taken substantially upon the plane indicated by the section line 2—2 of FIG. 1 and with the toe portion of an associated ski boot illustrated in operative association with the ski binding.
Figure 3:
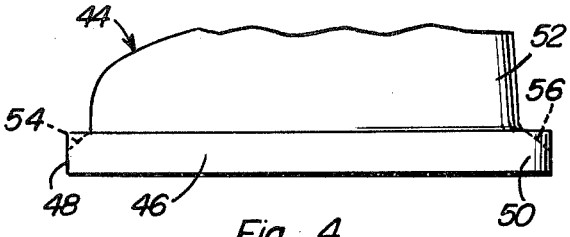
FIG. 3 is a fragmentary side elevational view of a ski boot constructed in accordance with the present invention.
Figure 4:
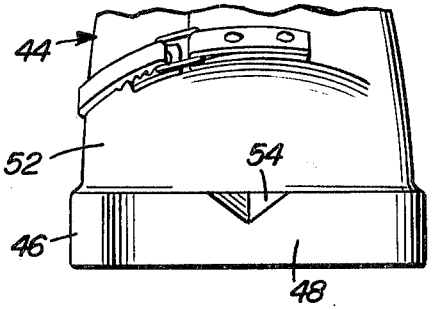
FIG. 4 is a fragmentary enlarged front elevational view of the ski boot illustrated in FIG. 3.
Figure 5:
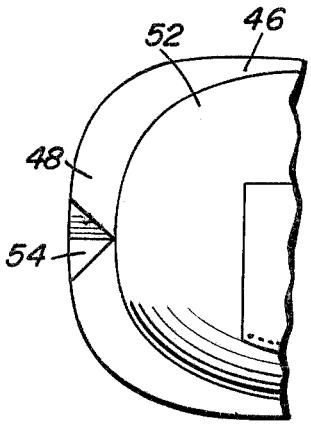
FIG. 5 is a top plan view of the forward portion of the ski boot illustrated in FIG. 4.

Accordingly, the boot 44 is attached to the ski 10 and yet may be disengaged therefrom as a result of sufficient forces being applied to the boot 44 in order to displace either of the abutment members 30 from their rest positions, note the phantom line position of the abutment member 30 illustrated in FIG. 2. Either upward, longitudinal or lateral forces applied to the boot 44 or a combination of such forces may result in one or both of the abutment members 30 being displaced from its rest position so as to enable the boot 44 to be readily disengaged from the ski 10. Of course, the abutment member 30 may be turned relative to the spring 22 so as to adjust the tension of the spring. Also, rotation of the abutment member 30 about the center axis of the spring and relative to the spacing sleeve 26 enables lateral forces applied to either end of the boot 44 to more readily result in disengagement of the boot 44 from the ski 10. Also, if the user of the ski 10 has equipped himself with ski poles, the lower end of a ski pole 60 may be downwardly seated in the blind bore 42 in order to enable the ski pole to be used as a lever by the user of the ski 10 while in a standing position to effect sufficient lateral displacement of the abutment member 30 to enable the boot 44 to be readily disengaged from the ski 10.

Figure 6:
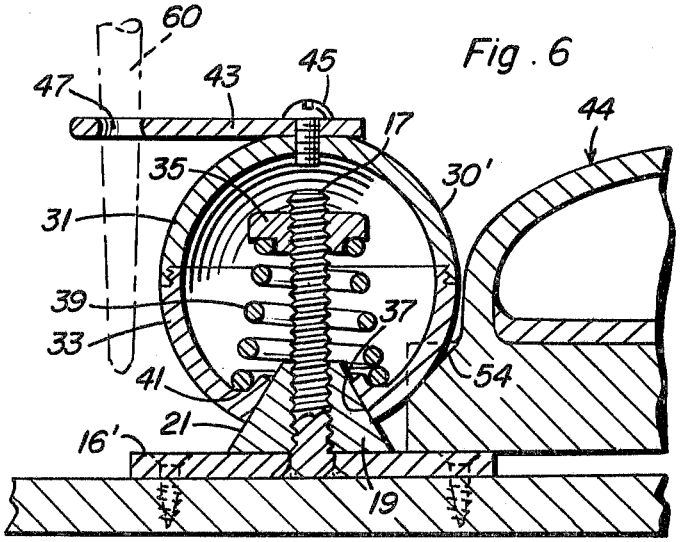
FIG. 6 is a fragmentary longitudinal vertical sectional view similar to FIG. 2 but illustrating a second form of the invention.

With attention now invited more specifically to FIG. 6 of the drawings there will be seen a modified form of the instant invention wherein a mounting plate 16′ corresponding to the mounting plate 16 is provided and includes an upstanding threaded shank 17. Further, a frusto-conical spacing sleeve 19 is utilized in lieu of the spacing sleeve 26 and is threaded downwardly on the shank 17, the sleeve 19 including an upwardly facing conical seating surface 21. In addition, a generally spherical but hollow abutment member 30′ is utilized in lieu of the abutment member 30 and it may be seen that the abutment member 30′ includes removably threadedlly engaged upper and lower half spherical sections 31 and 33 with the lower section 33 being provided with a lower conical opening 37 therethrough which is seated against the seating surfaces 21. A shouldered and threaded adjusting nut 35 is threadedly engaged with the upper end of the shank 17 and a coiled compression spring 39 is disposed about the shank 17 with its upper end seated against the shouldered underside of the nut 35 and its lower end seated against an annular seat 41 defined by the inner surface of the lower section 33 extending about the opening 37. Thus, the compression spring 39 serves to maintain the abutment member 30′ in predetermined position centered on the spacing sleeve 19.

The center of the upper section 31 has a horizontally outwardly projecting arm 43 secured thereto by means of a fastener 45 and the outer end of the arm 45 is provided with a vertical bore 47 formed therethrough in which the lower end of the ski pole 60 may be engaged for use of the ski pole 60 as a lever to laterally deflect the abutment member 30′. Of course, the abutment member 30′ is used in conjunction with the boot 44 wherein the underside of the abutment member 30′ will seat in the notch 54 of the boot 44.

Figure 7:
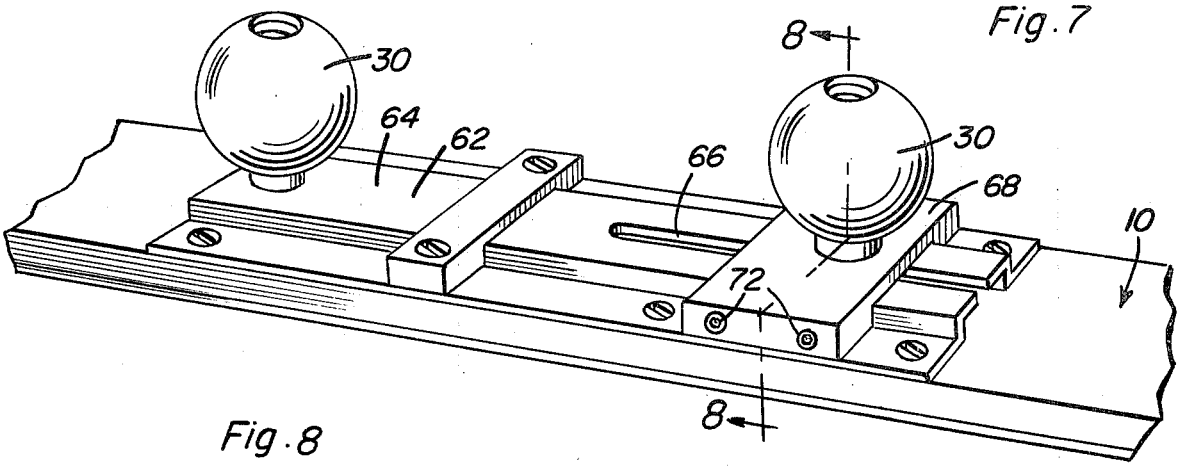
FIG. 7 is a fragmentary perspective view illustrating a ski having a third form of ski binding constructed in accordance with the present invention mounted thereon.
Figure 8:
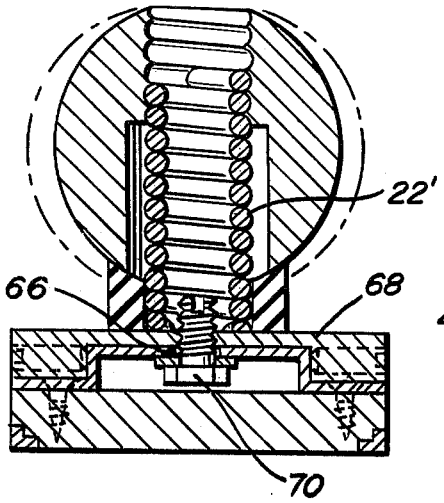
FIG. 8 is an enlarged fragmentary transverse vertical sectional view taken substantially upon the plane indicated by the section line 8—8 of FIG. 7.

With attention now invited more specifically to FIG. 7 of the drawings there will be seen a second modified form of the invention wherein a single mounting plate referred to in general by the reference numeral 62 is secured to the ski 10 and utilized for securing a pair of the abutment members 30 to the ski 10. The forward abutment member 30 is secured to the upper plate portion 64 of the mounting plate 62 in the same manner in which the forward abutment member 30 in FIGS. 1 and 2 is secured to the forward mounting plate 16. However, the rear portion of the plate portion 64 is provided with a longitudinal slot 66 and the rear abutment member 30 of FIG. 7 is supported from an auxiliary mounting plate secured to the mounting plate 62 by means of a fastener 70 slidable through the slot 66 and threadedly engaged with the auxiliary mounting plate 68, the lower end of the expansion spring 22′ corresponding to the expansion spring 22 being welded to the auxiliary mounting plate 68. Further, the abutment members 30 illustrated in FIG. 7 have had the plugs thereof corresponding to the plugs 36 illustrated in FIG. 2 removed and the auxiliary mounting plate 68 includes pairs of opposite side setscrews 72 for retaining the auxiliary mounting plate 68 in adjusted shifted position longitudinally of the mounting plate 62.

Figure 9:
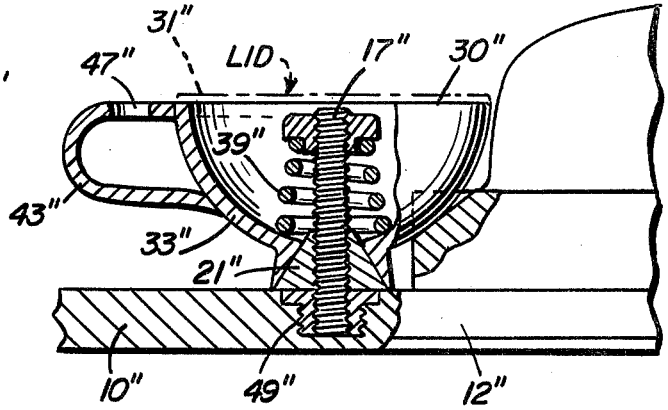
FIG. 9 is a fragmentary longitudinal vertical sectional view illustrating a fourth form of ski binding constructed in accordance with the present invention.

With attention now invited more specifically to FIG. 9 of the drawings there will be seen a third modified form of abutment member referred to by the reference numeral 30″. The abutment member 30″ includes a hollow hemispherical section 33″ corresponding to the section 30, but which is provided with a removable cover 31″ in lieu of the upper section 31. Further, the section 33″ is provided with a laterally outwardly projecting handle 43″ including an opening 47″ formed therein corresponding to the opening 47. The handle 43″ transforms the section 33″ into an abutment member which has the appearance of a teacup. Otherwise, the shank 17″ corresponding to the shank 17 has its lower end threadedly engaged in a removable insert 49″ threaded into the body 12″ of the ski 10″. However, a spacing sleeve 21″ corresponding to the sleeve 21 and a compression spring 39″ corresponding to the spring 39 are utilized to retain the section 33″ in seated position on the ski 10″. Accordingly, the operation of the abutment member 30″ is substantially identical to the operation of the abutment member 30′.

Figure 10:
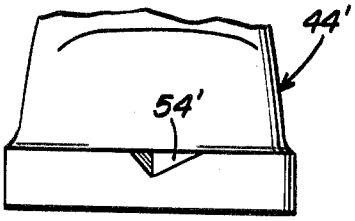
FIG. 10 is a fragmentary front elevational view of a modified ski boot constructed in accordance with the present invention.
Figure 11:
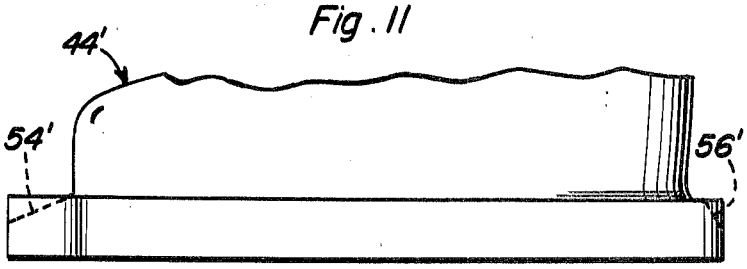
FIG. 11 is a side elevational view of the ski boot illustrated in FIG. 10.

In FIGS. 10 and 11 there is a modified form of ski boot illustrated generally referred to by the reference numeral 44′. The ski boot 44′ is substantially identical to the ski boot 44 except that the notches 54' and 56' are of slightly different configurations than the notches 54 and 56. From FIG. 10 of the drawings it may be seen that the side surfaces of the notch 54' are not identically inclined relative to a vertical longitudinal plane passing through the ski boot 44'. Accordingly, the notch 54' will allow a lateral force of lesser magnitude against the boot 44' in one direction to effect release of the boot 44 from any of the abutment members hereinabove described.

Figure 12:
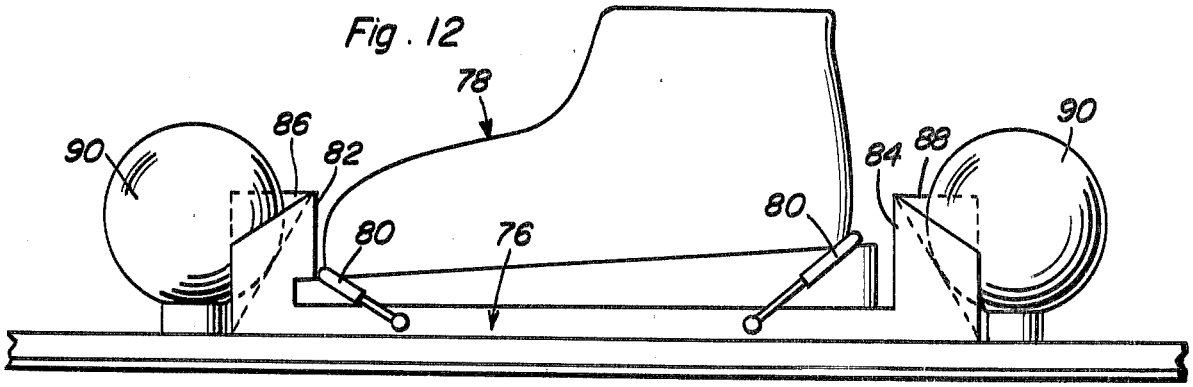
FIG. 12 is a fragmentary side elevational view of a third form of ski binding constructed in accordance with the present invention.

From FIG. 12 of the drawings it may be seen that a base plate structure referred to in general by the reference numeral 76 may be provided for a conventional ski boot referred to in general by the reference numeral 78 with the ski boot 78 removably attached to the base plate structure 76 by means of suitable spring clamps 80 and with the base plate structure 76 including opposite end portions 82 and 84 equipped with upwardly and outwardly opening notches 86 and 88 in which associated abutment members 90 corresponding to the abutment members 30 may be seated. In this manner, the ski binding of the instant invention may be utilized in conjunction with a conventional pair of ski boots.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a horizontal ski defining a ski boot sole receiving area, a ski boot disposed on said ski in said area, and first and second coacting means on said ski and boot releasably retaining said boot on said ski, said boot including toe and heel portions defining upwardly and outwardly opening oppositely inclined V-shaped notches defining said second means, said first means including a pair of abutment members having adjacent portions defining downwardly facing partial spherical abutment surfaces opposing and seated in said notches, support means supporting said abutment members in predetermined positions on said ski and for limited shifting of each abutment member upwardly away from said ski in all directions within an inverted conical zone thereabove, said support means including shifting resisting means yieldingly resisting shifting of said abutment members from said predetermined positions.

2. The combination of claim 1 wherein said support means includes means supporting one of said abutment members from said ski for adjustable shifting therealong.

3. The combination of claim 1 wherein said toe and heel portions are formed integrally with said sole.

4. The combination of claim 1 wherein said toe and heel portions comprises opposite end portions of a base plate structure removably supported from the under side of said sole.

5. In combination, a ski defining a ski boot sole receiving area, a ski boot disposed on said ski in said area, and first and second co-acting means on said ski and boot releasably retaining said boot on said ski, said boot including toe and heel portions defining upwardly and outwardly opening notches defining said second means, said first means including a pair of abutment members having adjacent portions defining downwardly facing abutment surfaces seated in said notches, support means supporting said abutment members in predetermined positions on said ski and for limited shifting of each abutment member away from the other, said support means including shifting resisting means yieldingly resisting shifting of said abutment members from said predetermined positions, said support means including a pair of base portions supported from said ski each defining a first upwardly facing seating surface and each of said abutment members defining a second downwardly facing seating surface seatingly engaged with the corresponding first seating surface, said shifting resisting means including adjustable spring means yieldingly resisting displacement of said abutment members relative to said base portions.

6. The combination of claim 5 wherein said first and second seating surfaces comprise partial conical seating surfaces.

7. The combination of claim 5 wherein said first and second seating surfaces includes partial spherical seating surfaces.

8. The combination of claim 5 wherein said spring means includes coiled compression spring means.

9. The combination of claim 5 wherein said spring means includes coiled tension spring means.

10. The combination of claim 5 wherein said support means includes a pair of base portions supported from said ski each defining a first upwardly facing seating surface and each of said abutment members defining a second downwardly facing seating surface seatingly engaged with the corresponding first seating surface, said shifting resisting means including adjustable spring means yieldingly resisting displacement of said abutment members wherein at least one of said abutment members includes means defining an upwardly opening socket in which to snugly receive the pointed end portion of a ski pole therein for enabling the ski pole to be used as a lever in laterally shifting said one abutment member away from the other abutment member.

11. The combination of claim 5 wherein said support means includes a pair of base portions supported from said ski each defining a first upwardly facing seating surface and each of said abutment members defining a second downwardly facing seating surface seatingly engaged with the corresponding first seating surface, said shifting resisting means including adjustable spring means yieldingly resisting displacement of said abutment members each of said abutment members includes a generally hemispherical undersurface comprising the corresponding second seating surface.

12. The combination of claim 11 wherein said support means includes means supporting said abutment members for angular displacement about center upstanding axes relative to said base portions.

13. The combination of claim 12 wherein said notches comprise V-shaped notches.

14. The combination of claim 13 wherein said notches define opposite side surfaces inclined at least substantially equally relative to a vertical plane extending longitudinally of said boot.

15. The combination of claim 13 wherein said notches define opposite side surfaces inclined differently relative to a vertical plane extending longitudinally of said boot.

16. The combination of claim 5 wherein said support means includes a pair of base portions supported from said ski each defining a first upwardly facing seating surface and each of said abutment members defining a second downwardly facing seating surface seatingly engaged with the corresponding first seating surface, said shifting resisting means including adjustable spring means yieldingly resisting displacement of said abutment members each of said abutment members includes a generally hemispherical undersurface comprising the corresponding second seating surface, said abutment members being generally spherical in shape.

17. The combination of claim 5 wherein said support means includes a pair of base portions supported from said ski each defining a first upwardly facing seating surface and each of said abutment members defining a second downwardly facing seating surface seatingly engaged with the corresponding first seating surface, said shifting resisting means including adjustable spring means yieldingly resisting displacement of said abutment members each of said abutment members includes a generally hemispherical undersurface comprising the corresponding second seating surface, said abutment members being generally hemispherical in shape.

18. In combination, a horizontal ski defining a ski boot sole receiving area, a skit boot disposed on said ski in said area, and first and second coacting means on said ski and boot releasably retaining said boot on said ski, said boot including toe and heel portions defining upwardly and outwardly opening notches defining said second means, said first means including a pair of abutment members spaced longitudinally of said ski and having adjacent portions defining downwardly facing abutment surfaces seated in said notches, support means supporting said abutment members in predetermined positions on said ski and for limited upward displacement of each abutment member from said ski in all directions within an inverted conical zone thereabove as well as limited shifting in all horizontal directions relative to said ski, said support means including shifting resisting means yieldingly resisting shifting of said abutment members from said predetermined positions.

19. The combination of claim 18 wherein said shifting resisting means is contained within the outer confines of each abutment member.

* * * * *